US007980834B2

(12) United States Patent
Maguire

(10) Patent No.: US 7,980,834 B2
(45) Date of Patent: Jul. 19, 2011

(54) LIQUID COLOR INJECTION PRESSURE BOOSTER PUMP AND PUMPING METHODS

(76) Inventor: Stephen B. Maguire, Glen Mills, PA (US)

( * ) Notice: Subject to any disclaimer, the term of this patent is extended or adjusted under 35 U.S.C. 154(b) by 1108 days.

(21) Appl. No.: 11/455,002

(22) Filed: Jun. 16, 2006

(65) Prior Publication Data

US 2007/0292290 A1 Dec. 20, 2007

(51) Int. Cl.
*F04B 17/00* (2006.01)

(52) U.S. Cl. ..... 417/399; 417/383; 417/384

(58) Field of Classification Search ..... 417/399, 417/397, 383–384, 375, 416; 366/167.1; 92/129

See application file for complete search history.

(56) References Cited

U.S. PATENT DOCUMENTS

| | | | | |
|---|---|---|---|---|
| 600,233 | A | 3/1898 | Palm | |
| 1,451,759 | A | 4/1923 | Bruhn | |
| 1,489,348 | A | 4/1924 | Hampton | |
| 2,186,646 | A | 1/1940 | Lincoln et al. | |
| 2,188,646 | A | 1/1940 | Bunch | |
| 2,199,657 | A | 5/1940 | Bunch | |
| 2,606,696 | A | 8/1952 | Miner | |
| 2,656,828 | A | 10/1953 | Conover | |
| 2,665,825 | A | 1/1954 | Poitras et al. | |
| 2,701,881 | A | 2/1955 | McGee | |
| 2,909,315 | A * | 10/1959 | Sampietro | 417/401 |
| 3,518,033 | A | 6/1970 | Anderson | |
| 3,814,388 | A | 6/1974 | Jakob | |
| 3,957,399 | A | 5/1976 | Siczek | |
| 3,988,088 | A | 10/1976 | King et al. | |
| 3,998,103 | A | 12/1976 | Bjorklund et al. | |
| 4,185,948 | A | 1/1980 | Maguire | |
| 4,473,173 | A | 9/1984 | DeGroff et al. | |
| 4,501,405 | A | 2/1985 | Usry | |

(Continued)

FOREIGN PATENT DOCUMENTS

DE 3433693 A1 3/1986

(Continued)

OTHER PUBLICATIONS

International Search Report dated Feb. 20, 2003 in connection with international application PCT/US02/02934 corresponding to U.S. Appl. No. 10/066,338, published as publication No. 2003/0142580.

(Continued)

*Primary Examiner* — Charles G Freay
*Assistant Examiner* — Todd D Jacobs
(74) *Attorney, Agent, or Firm* — Charles N. Quinn, Esq.; Fox Rothschild LLP

(57) ABSTRACT

A pump for boosting pressure of liquid color for injection into plastic resin in molding or extrusion apparatus includes a housing having a first bore extending in a first direction and second and third bores extending through the housing and communicating with the first bore proximate a first end of the first bore with the first end of the first bore being blind. The pump further includes an inlet check valve connectable to the second bore for permitting liquid flow through the second bore into the first bore. Further included is an outlet check valve connective to the third bore for permitting liquid flow out of the first bore through the third bore. A member is reciprocally axially movable within the first bore. A solenoid applies air pulses to the end of the first member facing oppositely from the blind end of the first bore.

2 Claims, 4 Drawing Sheets

U.S. PATENT DOCUMENTS

| | | | | |
|---|---|---|---|---|
| 4,571,416 | A | 2/1986 | Jarzombek et al. | |
| 4,586,882 | A | 5/1986 | Tseng | |
| 4,606,710 | A | 8/1986 | Maguire | |
| 4,621,990 | A * | 11/1986 | Forsythe et al. | 417/395 |
| 4,657,490 | A | 4/1987 | Abbott | |
| 4,967,940 | A | 11/1990 | Blette et al. | |
| 5,039,279 | A | 8/1991 | Natwick et al. | |
| 5,199,852 | A | 4/1993 | Danby | |
| 5,215,215 | A | 6/1993 | Sauer | |
| 5,225,210 | A | 7/1993 | Shimoda | |
| 5,344,232 | A | 9/1994 | Nelson et al. | |
| 5,364,242 | A | 11/1994 | Olsen | |
| 5,980,490 | A | 11/1999 | Tsoukalis | |
| 5,988,983 | A | 11/1999 | Furusawa | |
| 6,007,236 | A | 12/1999 | Maguire | |
| 6,057,514 | A | 5/2000 | Maguire | |
| 6,188,936 | B1 | 2/2001 | Maguire et al. | |
| 6,213,739 | B1 | 4/2001 | Phallen et al. | |
| 6,386,841 | B1 * | 5/2002 | Probst | 417/397 |
| 6,402,363 | B1 | 6/2002 | Maguire | |
| 6,599,005 | B2 | 7/2003 | van Der Wei | |
| 6,719,453 | B2 | 4/2004 | Cosman et al. | |
| 6,880,965 | B1 | 4/2005 | Sheffield, Jr. | |
| 7,154,069 | B1 | 12/2006 | Gordon | |
| 7,287,966 | B2 * | 10/2007 | French et al. | 417/416 |
| 7,419,367 | B2 * | 9/2008 | Rijnberg | 417/416 |
| 7,726,950 | B2 * | 6/2010 | Hansen et al. | 417/225 |
| 2002/0031822 | A1 | 3/2002 | van der Wei et al. | |
| 2003/0142580 | A1 | 7/2003 | Maguire | |
| 2003/0218014 | A1 | 11/2003 | Gregory et al. | |
| 2005/0052945 | A1 | 3/2005 | Maguire | |

FOREIGN PATENT DOCUMENTS

| | | |
|---|---|---|
| GB | 1145752 | 3/1969 |

OTHER PUBLICATIONS

Written Opinion dated Mar. 24, 2003 in connection with international application PCT/US02/02934 corresponding to U.S. Appl. No. 10/066,338, published as publication No. 2003/0142580.

Forty-four page two-sided brochure including cover and back pages entitled "Maguire: Auxiliary equipment for the plastics industry" of Maguire Products, Inc., Oct. 2000.

Two-sided color brochure entitled Maguire: Model MPA Liquid Color Pump, Maguire Products, Inc., undated.

Thirty-two page catalog entitled "Maguire Color Blending Equipment" published by Maguire Products, Inc., 1993.

* cited by examiner

LIQUID COLOR INJECTION PRESSURE BOOSTER PUMP AND PUMPING METHODS

BACKGROUND OF THE INVENTION

1. Field of the Invention

This invention relates generally to processing of resin material for fabrication into finished articles and more particularly to methods and apparatus for furnishing liquid color material used to impart a desired color to the finished plastic part.

2. Description of the Prior Art

When liquid color is used to impart a desired color to finished parts produced by molding or extrusion, the liquid color is normally introduced into the process at the throat of the process machine, along with the flow of plastic resin or pellets. In this context the "throat" of the process machine refers to the position at which the plastic resin is initially introduced into a barrel surrounding one or more extrusion screws, if the process machine is a extruder, or the position at which the plastic resin is initially introduced into the screw barrel housing, if the process machine is an injection molding press.

At the throat of the process machine, whether it be an extruder or a molding press, the tube carrying the liquid color from the liquid color supply can simply be placed in location and the liquid color metered or dripped into the flow of the plastic resin material to be processed. No significant liquid color pressure is required for the liquid color to be introduced into the process and combined with the plastic resin or pellets at the throat of the process machine.

It is advantageous to introduce the liquid color further along in the process, i.e. downstream, closer to the position at which the finished plastic parts are produced. By introducing the liquid color further along in the process, namely closer to the position where the final plastic parts are produced, this reduces clean out time and reduces color changeover time.

When colors are changed, some of the coloring agent, whether the agent be liquid color or solid color pellets, is always lost due to the time required to purge the old color from the process machine and to introduce the new coloring agent at full strength. Reduced color changeover time translates into savings in time and reduction in the amount of coloring agent, namely liquid color, that is always unavoidably lost. This can be a very significant cost saving to entities operating numerous extruders and injection molding machines to produce many finished, colored parts.

If liquid color is introduced into the barrel of a extruder screw, downstream from the throat, there is no color at the throat. Hence, there is no color contamination at the throat and color changeover can take place in much less time.

A problem with this approach, namely introducing liquid color into the extrusion screw barrel downstream of the throat, is that pressure in the extrusion screw barrel must be overcome by the metering pump delivering the liquid color. Pressure required to overcome the internal pressure within the extruder screw barrel is between four hundred (400) and fifteen hundred (1500) psi, depending on the location at which the pressure is measured and the particular extruder involved.

Previously, pumps have been used with limited success to supply liquid color directly into the barrel of an extruder screw. Gear pumps have been used, which have the advantage of allowing control of metering rates by simply varying the speed of the gear pump. Varying pump speed, coupled with the high pressure involved in delivering the liquid color, has resulted in the some use of gear pumps to deliver liquid color since gear pumps are "positive displacement pumps", i.e., gear pumps inherently produce the high pressure required to supply liquid color material directly into the barrel of an extruder screw.

However, gear pumps all have closely fitting, fine tolerance parts, namely the meshing gears. This is a disadvantage because many color pigments are abrasive. White color pigment, which is titanium dioxide, is extremely abrasive and is similar to finely ground stone. Using a gear pump to feed color pigment as a component of liquid color, particularly white liquid color with its very fine particles of titanium dioxide, wears the gears in a gear pump to an unacceptable point in a very, very short time.

A further disadvantage of gear pumps is that they are very expensive.

These factors have kept high pressure injection of liquid color into the barrel of an extruder screw or into the barrel of an injection molding machine screw, at a position downstream from the throat, from being a practical process for operators of injection molding machines and extruders producing finished colored plastic parts. Processors simply have not embraced the introduction of liquid color into the barrels of extruder screws or injection molding machines at positions removed from the throat.

SUMMARY OF THE INVENTION

The liquid color injection pressure booster pump of this invention solves the problem described above in two ways. First, the liquid color injection pressure booster pump in accordance with the invention is a very low cost device, having no expensive parts. A very low cost pressure seal is the only wear item in the pump, should the liquid color attack this part.

Secondly, the liquid color injection pressure booster pump of this invention utilizes a design that tends to keep the liquid away from the seal, thereby extending the life of even the seal, which, as noted above, is the only wear item. The liquid color injection booster pump of this invention is air actuated and does not require a drive motor.

The booster pump of the invention is not a metering device for metering the liquid color to the process machine, either an extruder or a molding press, but is only a pressure booster, providing a higher pressure for the liquid color thereby permitting the liquid color to be injected into the extruder screw barrel or the molding machine screw barrel at a position downstream from the throat, i.e. injected closer to the position at which the finished plastic parts are molded or extruded.

With the apparatus of the invention, there is no variation in performance of the booster pump that affects accuracy of the delivery of the required amount of liquid color. This is because accuracy, namely delivery of the desired amount of the liquid color, is controlled by the metering pump or other device that supplies liquid color to the injection pressure booster pump of the invention.

The injection pressure booster pump of the invention accepts only liquid color that is metered to it and boosts the output pressure of the liquid color to the high pressure required for injection of the same into the barrel of an extruder screw or the barrel of an injection molding press.

Output of the booster pump is a function of the ratio of the diameter of the air cylinder driving the air cylinder piston to the diameter of the internal pumping piston.

The injection pressure booster pump is operated by a solenoid that turns on and off, with a repeat cycle timer actuating the solenoid. The injection pressure booster pump runs continuously without regard to what is metered to it, i.e., without regard to whether any liquid color is being supplied to it. As liquid color is metered to the injection pressure booster pump, the pumping piston is displaced, namely pushed or driven back towards the solenoid. Once each second or even more often this pumping piston is driven forward, or pulsed forward, producing high pressure in front of the pumping piston. Check valves allow the liquid to move at this high pressure towards the extruder. The duration of the pulse stroke of the injection pressure booster pump is very short, for example on the order of about three tenths of one second. When the pulse stroke ends, air exhausts from the air cylinder and a spring in the air cylinder returns the driving piston within the air cylinder to its retracted position. The pumping piston is not connected to the air cylinder. The pumping piston does not get pulled back. Only the introduction of liquid color into the forward chamber of the injection pressure booster pump will push the pumping piston back to the starting position. Any liquid color that meters in during the "off" time is then pulsed out by forward movement of the pumping piston during the next "on" time or pulse.

Accordingly, in one of its aspects this invention provides a pump for boosting pressure of liquid color for injection of the liquid color into plastic resin within molding or extrusion apparatus, where the pump includes a housing having an elongated first bore extending in a first direction, and second and third bores extending through the housing and communicating with the first bore proximate a first end thereof, with the first end of the first bore otherwise being blind.

The pump further includes an inlet check valve connected to the second bore for permitting liquid flow through the second bore into the first bore but blocking liquid flow out of the first bore through the second bore. The pump yet further includes an outlet check valve connected to the third bore for permitting liquid flow out of the first bore through the third bore but blocking liquid flow into the first bore through the third bore. The pump still yet further includes a pumping piston reciprocally moveable within the first bore.

When a source of liquid color is connected to the inlet check valve and liquid color flows past the inlet check valve bore through the second bore and into the first (or main or primary) bore, and the pumping piston strokes forward towards the blind end of the first bore, the liquid color is driven from the first bore through the third bore, past the outlet check valve, and into plastic resin in the molding or extrusion apparatus.

The check valves may be within the housing.

The piston-cylinder combination is desirably pneumatically driven.

The housing is desirably a casting.

In yet another of its aspects this invention provides a method for elevating pressure of liquid color to enable injection of the liquid color directly into the barrel housing of an extruder screw or an injection molding machine ram, where the method includes the steps of filling a chamber with liquid color flowing into the chamber under pressure through an inlet, closing the inlet and advancing a piston into the liquid color in the chamber, thereby reducing the volume of the chamber, necessarily increasing the liquid color pressure, and dispensing the liquid color at such increased pressure out of the chamber via an outlet leading to the barrel housing of the extruder screw or the molding ram. In this aspect of the method, advancing the piston is preferably performed pneumatically.

This aspect of the method yet further comprises serially closing the outlet, opening the inlet and repeating the steps of filling the chamber, closing the inlet and advancing the piston as recited above in sequence, for so long as liquid color at elevated pressure is required for direct injection into the barrel housing of an extruder screw or an injection molding ram.

In this aspect of the method the chamber is preferably cylindrical, the piston is preferably cylindrical and slidably reciprocable within the cylindrical chamber towards and away from a blind chamber end, with the inlet and outlet, to and from the chamber, being at the chamber blind end.

In yet another variation of this aspect of the invention, closing the inlet further comprises placing a first check valve in an inlet passageway emptying into a chamber, permitting flow into the chamber but precluding flow out of the chamber via the inlet passageway.

In yet another variation of this aspect of the invention, closing the outlet further comprises placing a second check valve in a discharge passageway exiting the chamber, permitting flow from the chamber but precluding flow into the chamber via the discharge passageway.

DESCRIPTION OF THE DRAWINGS

In FIG. 3 an internal reciprocable pumping piston is illustrated in an advanced position, having completed a pumping stroke.

In FIG. 4 the internal reciprocable pumping piston is illustrated in a retracted position, ready to initiate a pumping stroke.

In FIGS. 3 and 4, the check valves depicted in FIGS. 1 and 2 are shown in schematic form.

DESCRIPTION OF THE PREFERRED EMBODIMENTS AND BEST MODE KNOWN FOR PRACTICE OF THE INVENTION

Figure 1:
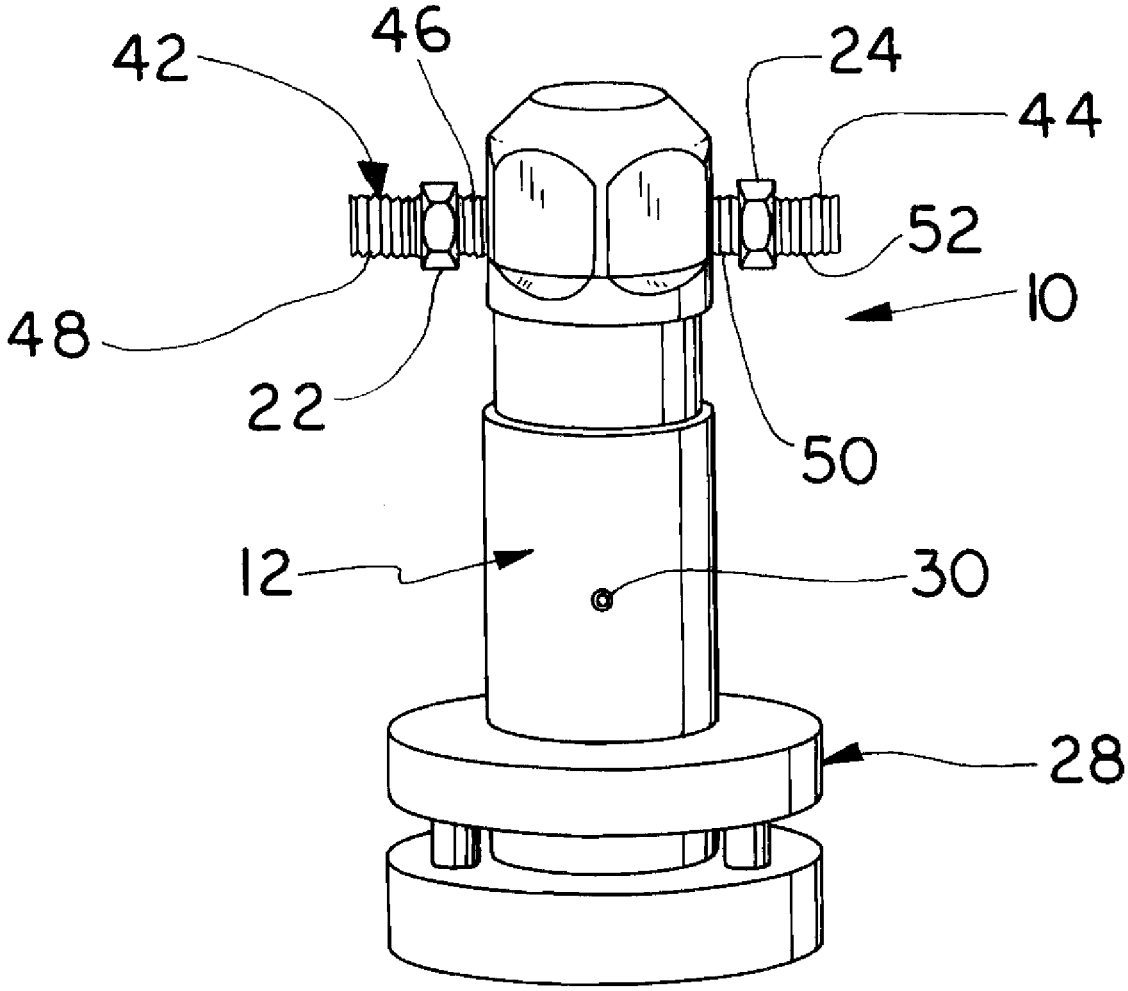
FIG. 1 is a perspective view, in front elevation, of a liquid color injection pressure booster pump in accordance with the invention, in an assembled condition.

Referring to the drawings in general and to FIG. 1 in particular, a liquid color injection pressure booster pump in accordance with the preferred embodiment of the invention is designated generally 10 and includes a housing designated generally 12 that is connected to an air cylinder/solenoid combination designated generally 28. A vent aperture 30 is provided in housing 12, as explained in more detail below.

Figure 3:
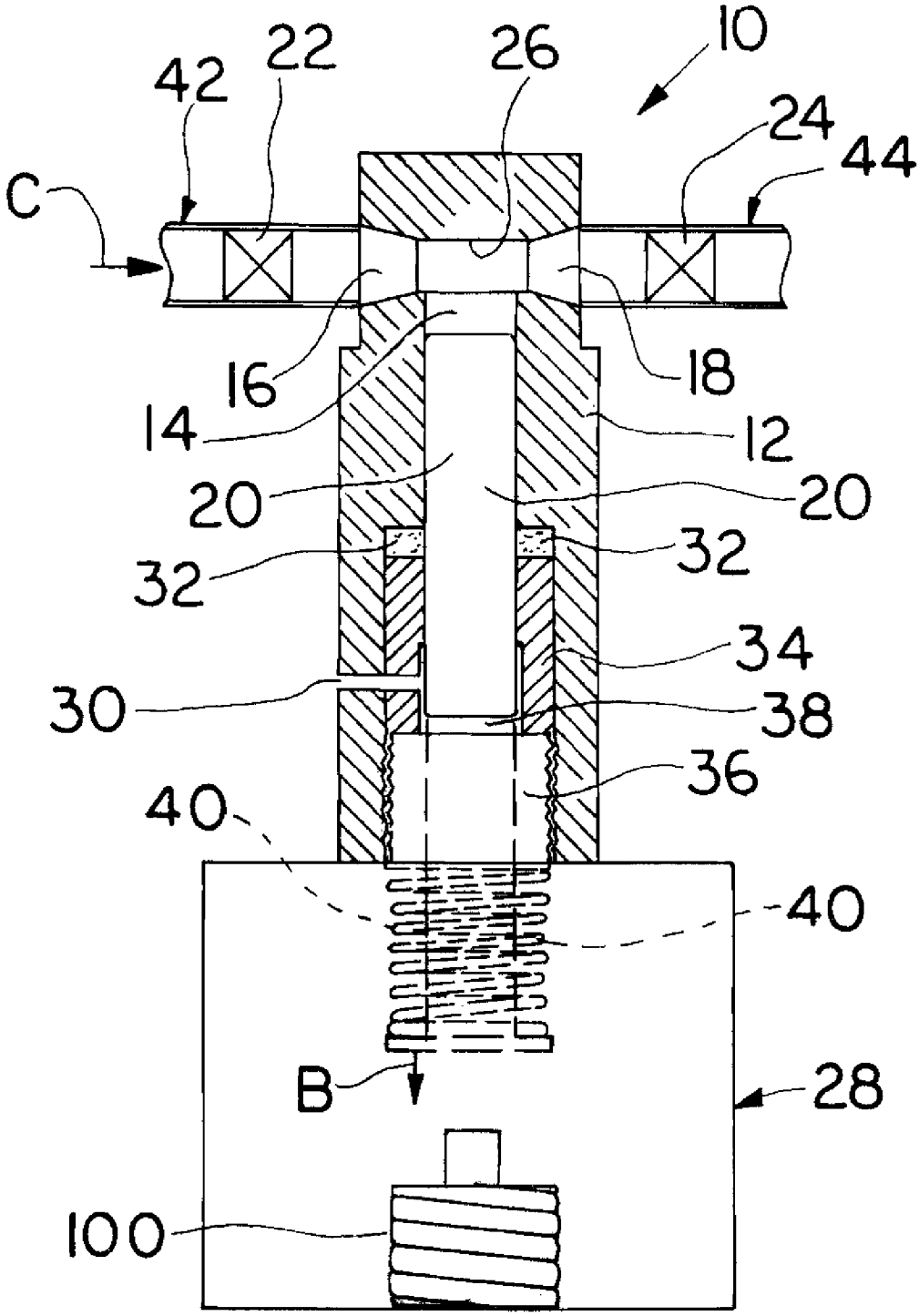
FIG. 3 is a schematic front elevation, partially in section, of the liquid color injection pressure booster pump illustrated in FIGS. 1 and 2, taken looking generally in the same direction as FIG. 1.
Figure 4:
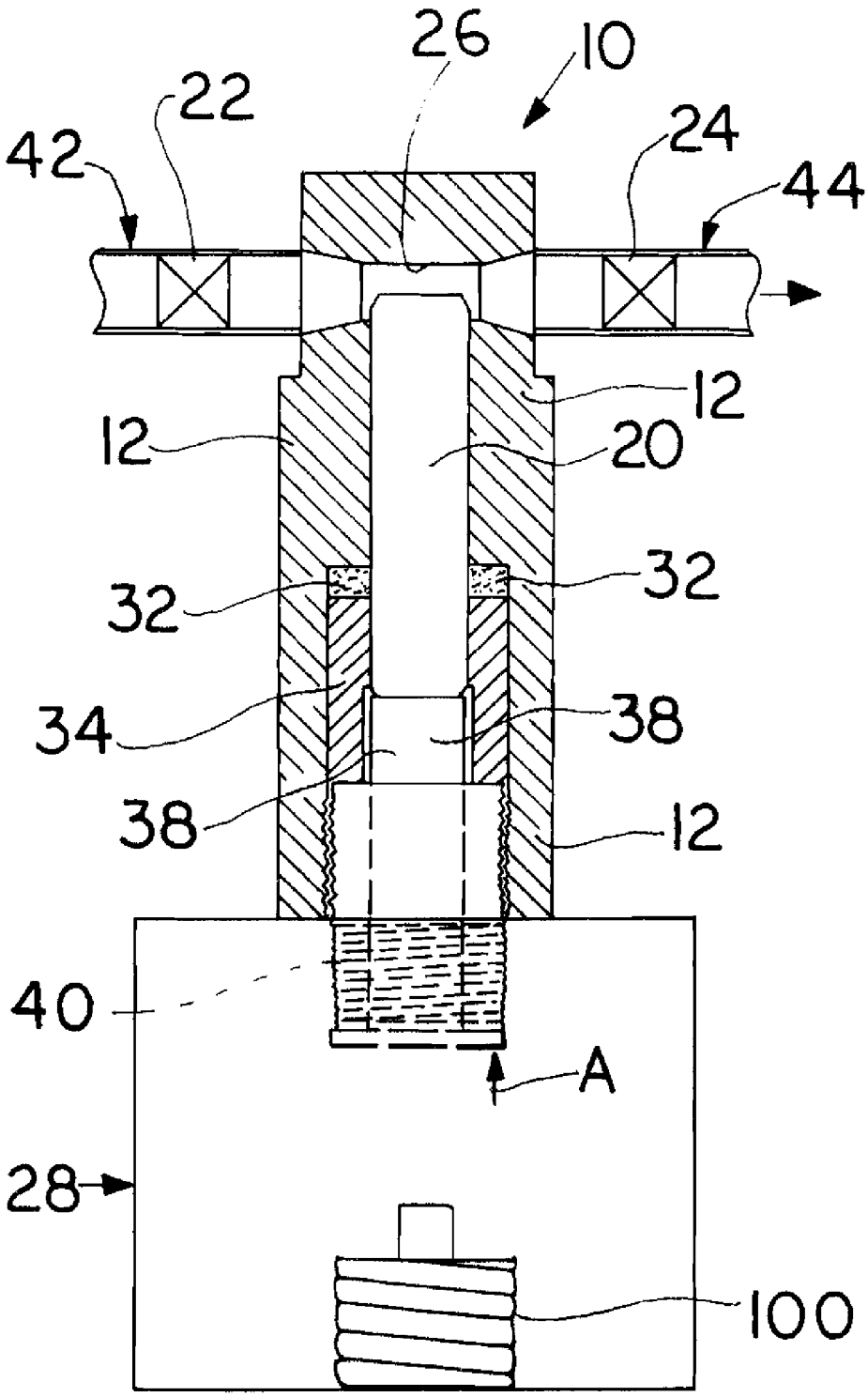
FIG. 4 is a schematic front elevation, partially in section, of the liquid color injection pressure booster pump illustrated in FIGS. 1, 2 and 3, taken looking generally in the same direction as FIG. 1.

An inlet passageway to liquid color injection pressure booster pump 10, for flow of liquid color therethrough, is designated generally 42 in FIG. 1. Inlet passageway 42 may be defined by a first threaded pipe nipple 46 and a second threaded pipe nipple 48, both shown in FIG. 1, where inlet check valve 22 is positioned between and in threaded engagement with first and second threaded pipe nipples 46, 48. Pipe nipple 46 may threadedly engage a first bore designated 14, which is not shown in FIG. 1, but is shown in FIGS. 3 and 4 as described in more detail below, which bore is formed in housing 12.

Similarly, an outlet passageway from housing 12, which is designated generally 44 in FIG. 1, may be defined by a third preferably externally threaded pipe nipple 50 and a fourth preferably externally threaded pipe nipple 52, where third preferably externally threaded pipe nipple 50 may threadedly engage a third bore 18, which is not shown in FIG. 1. Third bore 18 is illustrated in FIGS. 3 and 4, is described below, and forms a part of outlet passageway 44. Similarly, fourth preferably externally threaded pipe nipple 52 preferably forms a portion of outlet passageway 44. An outlet check valve 24, shown schematically in FIG. 1, is preferably threadedly engaged by third and fourth preferably externally threaded pipe nipples 50 and 52 and is positioned therebetween, for flow of liquid color from the liquid color injection pressure booster pump 10 via outlet passageway 44 and preventing any backflow.

While not visible in FIG. 1, housing 12 includes an elongated internal bore, referred to as a first bore and designated generally 14 in the drawings, extending in a first direction. Housing 12 further includes second and third bores, neither of which are illustrated in FIG. 1, extending through housing 12 and communicating with first bore 14 proximate a first end of bore 14, where the first end of first bore 14 is blind and designated generally 26.

Figure 2:
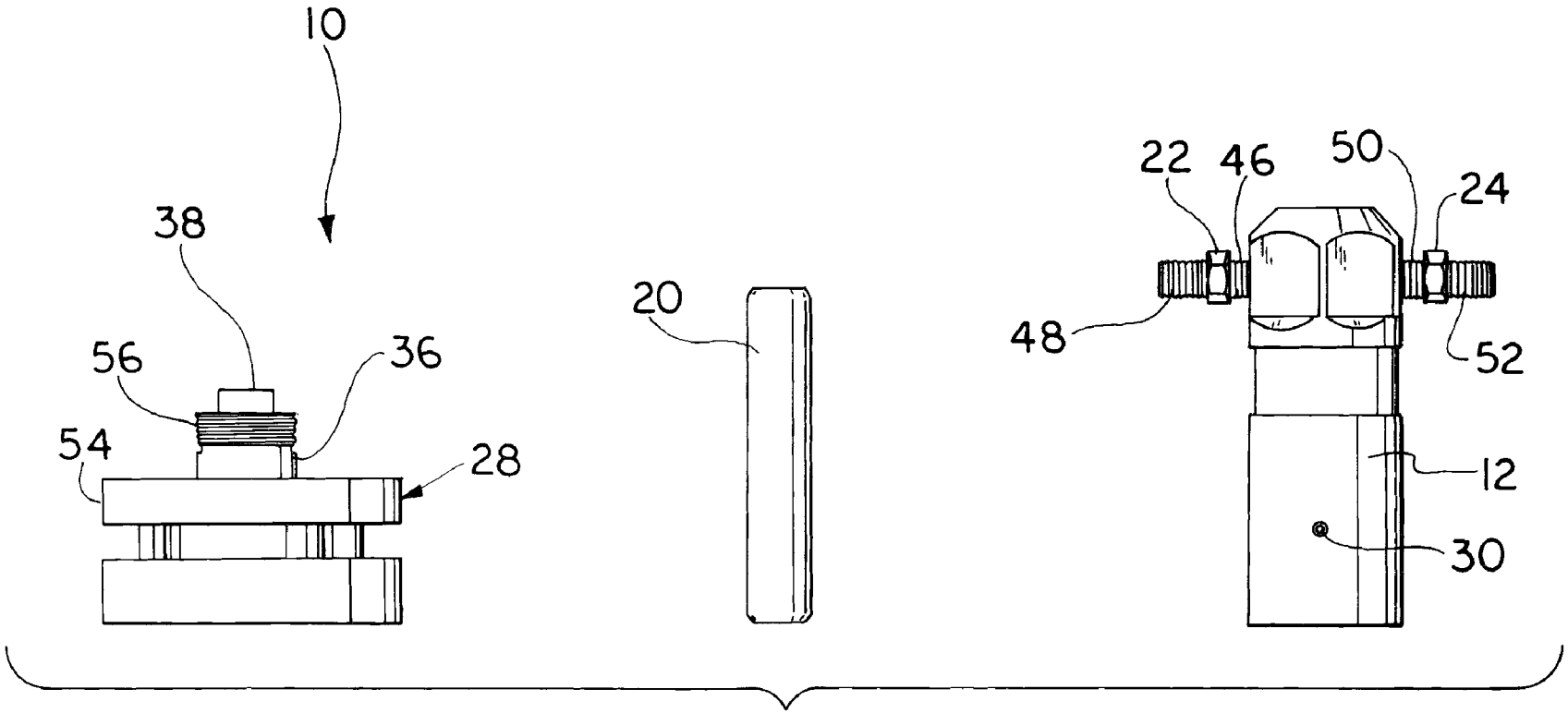
FIG. 2 is a front elevation of the liquid color injection pressure booster pump illustrated in FIG. 1, where the pump has been partially disassembled.

FIG. 2 illustrates liquid color injection pressure booster pump 10 in a disassembled condition, with housing 12 having been separated from air cylinder 28 by threadedly disengaging housing 12 from air cylinder 28. As further illustrated in FIG. 2, air cylinder 28 includes a stud 36, of generally cylindrical configuration, extending from a main body portion 54 of air cylinder 28. An end of cylindrical stud 36 remote from main body portion 54 of air cylinder 28 is externally threaded, where these external threads are designated generally 56 in FIG. 2. Air cylinder 28 engages housing 12 via external threads 56 threadedly mating with complemental threads formed in an interior bore portion of housing 12, as illustrated generally in FIGS. 3 and 4.

Extending out of stud 36 is an air cylinder piston 38 which moves reciprocally upon application of pressurized air to air cylinder 28 and input of an appropriate electrical signal to a solenoid portion 100 of air cylinder 28, where the solenoid is not illustrated. The solenoid 100 reciprocates at a desired speed, according to electrical signals provided thereto at a desired frequency, thereby providing pressurized air from an external supply to drive air cylinder piston 38 during the forward portion of the air cylinder piston stroke. Air cylinder piston 38 returns to a retracted position under the influence of an air cylinder return spring designated generally 40 and shown schematically in FIGS. 3 and 4. Air cylinder piston 38 is illustrated in its advanced, extended position in FIG. 4, having been pushed to that position by the application of pressurized air. When application of pressurized air ceases and the cylinder within which piston 38 resides is vented to atmosphere, return spring 40 acts on an end portion of air cylinder piston 38, to withdraw air cylinder piston 38 to the position generally illustrated in FIG. 3. Application of pressurized air to air cylinder piston 38, as effectuated by the solenoid 100, is denoted by Arrow A in FIG. 4. Application of the spring return force, serving to withdraw air cylinder piston 38 from the extended position illustrated in FIG. 4 to the retracted position illustrated in FIG. 3, is denoted by Arrow B in FIG. 3. Air cylinder 28 and the associated solenoid are commercially available, off the shelf items, and, accordingly, have not been illustrated in detail in the drawings.

As mentioned above and as illustrated in FIGS. 3 and 4, housing 12 is secured in position over cylindrical stud 36 of air cylinder 28 such that air cylinder piston 38, when extended, may drive a pumping piston 20, which is removably reciprocally within housing 12. Specifically, pumping piston 20 is driven by air cylinder piston 38 along a first bore 14 in housing 12, towards a blind end 26 of first bore 14. Pumping piston 20 is illustrated in FIG. 2 removed from injection pressure booster pump 10. Engagement of the internal threads within housing 12 with the external threads formed on the outer extremity portion of cylindrical stud 36 of air cylinder 28 secures housing 12 to air cylinder 28.

As best seen in FIGS. 3 and 4, first bore 14 extending within housing 20 has a smaller diameter portion proximate closed end 26 of first bore 14, which smaller diameter portion is sized for sliding reciprocal movement of pumping piston 20 therealong. First bore 14 has a larger diameter portion extending along the axial length thereof that is more proximate air cylinder 28. This second, larger diameter portion joins the first, smaller diameter portion at a step, not numbered but clearly shown in FIGS. 3 and 4. Positioned adjacent to the step is an annular seal 32 within which pumping piston 20 fits and is slidably movable as respecting annular seal 32.

Annular seal 32 is maintained in place by a spacer 34 which, upon assembly of liquid color injection pressure booster pump 10, is pressed axially against seal 32 by an outer radial extremity of cylindrical stud 36, as illustrated in FIGS. 3 and 4. This maintains annular seal 32 tightly in position to perform the sealing function. Seal 32 serves to isolate the liquid color portion of first bore 14 that is bounded at one end by blind end 26, keeping the liquid color away from air cylinder 28 and the associated solenoid thereby providing great reliability for the liquid color injection booster pump 10.

During operation of liquid color injection pressure booster pump 10, a source of liquid color is connected to inlet passageway 42 and provides liquid color, as indicated by Arrow C in FIG. 3. Liquid color provided to inlet passageway 42 is under some very moderate pressure and thereby flows through inlet check valve 22 and through second bore 16, which in part defines inlet passageway 42 into first bore 14 and particularly into the portion thereof above pumping piston 20, when considering FIG. 3. This liquid color proceeds substantially to fill the volume defining the portion of first bore 14 above pumping piston 20, the portion of inlet passageway 42 that is downstream of inlet check valve 22, and the portion of outlet passageway 44 that is upstream of outlet check valve 24.

When air cylinder 28 is then actuated and air cylinder piston 38 extends, air cylinder piston 38 contacts the bottom (considering FIGS. 3 and 4) of pumping piston 20. This action drives pumping piston 20 upwardly, considering FIGS. 3 and 4, into liquid color occupying the portion of first bore 14 above pumping piston 20.

As pumping piston 20 advances from the position illustrated in FIG. 3 to the position illustrated in FIG. 4, the effective volume of first bore 14 above pumping piston 20 is reduced, thereby increasing the pressure of liquid color in this volume and driving this liquid color, under such increased pressure, out of liquid color injection pressure booster pump 10 via outlet passageway 44, with the liquid color passing through outlet check valve 24.

Once air cylinder 28 has advanced air cylinder piston 38 to the position illustrated in FIG. 4, air pressure on air cylinder piston 38 is relieved, allowing air cylinder return spring 40 to withdraw air cylinder piston 38 from the position illustrated in FIG. 4 to the position illustrated in FIG. 3. Since the volume of first bore 14 above pumping piston 20 has now been at least somewhat evacuated of liquid color due to the liquid color having left that area under high pressure via outlet passageway 44, liquid color from the supply, being under moderate, lower pressure, may enter the volume of first bore 14 above pumping piston via inlet passageway 42, passing through inlet check valve 22. The moderate pressure of liquid color coming into the volume of first bore above pumping piston 20 forces pumping piston 20 downwardly considering FIGS. 4 and 3, from the position illustrated in FIG. 4 to the position illustrated in FIG. 3.

Once this occurs, the pumping cycle may be repeated, with the solenoid actuating air cylinder 28, serving to extend air cylinder piston 38 against pumping piston 20, thereby driving pumping piston 20 into the liquid color, reducing the effective volume of first bore 14 above pumping piston 20 and increasing the pressure of the liquid color in that area, thereby forcing liquid color out of that volume through outlet passageway 44 at high pressure.

Venting aperture 30 connects to first bore 14 at a position at which spacer 34 has an internal diameter slightly larger than the external diameter of pumping piston 20, with venting aperture 30 being illustrated in FIG. 3. As noted above, air cylinder piston 38 touches and pushes directly on pumping piston 20 during the pumping stroke. Venting aperture 30 serves to vent the portion of first bore 14 that is of larger diameter, namely that portion beginning with the step at which annular seal 32 is located. In the event liquid color leaks past annular seal 32, the liquid color will leak out of pump 10 through venting aperture 30 and will not damage air cylinder 28, which parts are, of course, necessarily sealed due to the use of high pressure air to actuate air cylinder piston 38. Venting aperture 30 additionally permits visual inspection, to observe operation and to monitor the stroking of air cylinder piston 38 and the resultant upward (respecting FIGS. 3 and 4) pumping motion of pumping piston 20.

The solenoid, which is not shown since it is a commercially available item which may be purchased as part of or separate from the air cylinder, controls the supply of pressurized air to air cylinder 28. When deenergized, the solenoid vents the same cylinder port, via which the pressurized air is supplied to the cylinder position of air cylinder 28, to atmosphere. This allows cylinder return spring 40 to return air cylinder piston 38 to the starting position, at which air cylinder piston 38 is retracted, as illustrated generally in FIG. 3. As further illustrated in FIG. 3, the air cylinder return spring 40 acts as a compression spring and is positioned around the unnumbered air cylinder piston rod, inside the housing of air cylinder 20.

During operation, movement of pumping piston 20, once air cylinder piston 38 has retracted, is effectuated by the pressure of the incoming liquid color. Pumping piston 20 moves downwardly, respecting FIGS. 3 and 4, only as far as the amount of liquid color entering the pump via inlet passageway 42, will move pumping piston 20. Accordingly, the amount of downward vertical movement of pumping piston 20 is variable, depending on the flow and flow rate of liquid color into first bore 14 via inlet passageway 42.

Pressure of liquid color, output by liquid color injection pressure booster pump 10, exiting the pump via outlet passageway 44, is a function of the ratio of the diameter of the cylinder portion of air cylinder 28, driving air cylinder piston 38, to the diameter of pumping piston 20. In one embodiment of liquid color injection pressure booster pump 10, this ratio is four to one, where the diameter of the cylinder portion of air cylinder 28, driving air cylinder piston 38, has been three inches (3") and the diameter of pumping piston 20 has been three-quarters of an inch (¾"). This results in a ratio of the two areas of sixteen to one (16:1). Hence, if the air supplied to air cylinder 28 is at one hundred pounds per square inch, (100 psi—which is not untypical of the pressurized air used for multiple functions in many extrusion and molding facilities), output pressure of liquid color exiting liquid color injection pressure booster pump 10 via outlet passageway 44 will be one thousand six hundred pounds per square inch (1,600 psi).

The solenoid is desirably turned on and off about once a second, using a repeat cycle timer to control operation of the solenoid. The solenoid, as actuated by the repeat cycle timer preferably runs continuously without regard to whether liquid color is being metered or supplied to liquid color injection pressure booster pump 10.

As liquid color is metered into liquid color injection pressure booster pump 10 via inlet passageway 42, pumping piston 20 is displaced or pushed downwardly as respecting FIGS. 3 and 4.

In one preferred practice of the invention, air cylinder 28 is actuated once each second, driving air cylinder piston 38 upwardly respecting FIGS. 3 and 4, contacting the bottom of pumping piston 20 and driving pumping piston 20 upwardly into the region of first bore 14 occupied by liquid color. Check valves, including outlet check valve 24, permit this liquid to move under very high pressure, such as the 1,600 psi figure mentioned above, towards an extruder or injection molding machine ram barrel. Time duration of the stroke of the air cylinder piston 38 and hence of pumping piston 20 is very short, on the order of three-tenths of one second (0.3 seconds). Once a stroke ends, air is exhausted naturally from the air cylinder 28 and air cylinder return spring 40 returns the air cylinder piston 38 to its retracted position.

However, since pumping piston 20 is not connected to air cylinder piston 38, pumping piston 20 does not get pulled back or downwardly as respecting FIGS. 3 and 4. Only introduction of liquid color into the chamber defined by the upper portion of first bore 14 and the portions of second and third bores 16, 18 inboard of check valves 22 and 24, works to push pumping piston back or downwardly in FIGS. 3 and 4. Any liquid color metered into this chamber during the time the air pressure is off, due to the solenoid being in the off portion of its cycle, is then pushed out of liquid color injection pressure booster pump 10 through outlet passageway 44 during the next "on time" or pulse as initiated by the solenoid causing pressurized air to enter air cylinder 28, driving air cylinder piston 38 upwardly, thereby forcing pumping piston upwardly as respecting FIGS. 3 and 4.

The invention claimed is:

1. A method for furnishing liquid color at elevated pressure for injection thereof directly into the barrel housing of an extruder screw or an injection molding ram, comprising:

a) allowing a chamber to fill with liquid color entering the chamber at a first pressure through an inlet;

b) closing the inlet;

c) energizing a solenoid to move a piston of an air cylinder-piston combination in a direction to contact and advance a free-floating pumping piston along a cylindrical part of the chamber into liquid color occupying the chamber thereby displacing the liquid color at pressure increased from the first pressure out of the chamber via an outlet leading to a barrel housing of an extruder screw or an injection molding ram;

d) de-energizing the solenoid so as to permit spring bias to withdraw the piston of the air cylinder-piston combination away from the free-floating pumping piston and thereby permit new liquid color entering the chamber to urge the free-floating pumping piston away from the liquid color displacement position and towards the piston of the air cylinder-piston combination.

2. In a method for furnishing liquid color at elevated pressure for injection thereof directly into the barrel housing of an extruder screw or an injection molding ram, the steps comprising energizing a solenoid driving a first piston in a first direction to contact and advance a free-floating pumping piston along a cylindrical part of a chamber into liquid color occupying the chamber thereby displacing the liquid color from the chamber to a barrel housing of an extruder screw or an injection molding ram and-de-energizing the solenoid so as to permit spring bias to draw the first piston away from the free-floating pumping piston thereby permitting liquid color entering the chamber to urge the free-floating pumping piston towards the first piston.

* * * * *